US006067063A

United States Patent [19]

Kim et al.

[11] Patent Number: 6,067,063

[45] Date of Patent: May 23, 2000

[54] LIQUID CRYSTAL DISPLAY HAVING A WIDE VIEWING ANGLE AND METHOD FOR DRIVING THE SAME

[75] Inventors: Sang-soo Kim, Seoul; Dong-gyu Kim; Tae-sung Kim, both of Suwon-si, all of Rep. of Korea

[73] Assignee: Samsung Electronics Co., Ltd., Kyungki-do, Rep. of Korea

[21] Appl. No.: 08/678,874

[22] Filed: Jul. 12, 1996

[30] Foreign Application Priority Data

Jul. 12, 1995 [KR] Rep. of Korea ..... 95-20490

[51] Int. Cl.[7] ..... G09G 3/36

[52] U.S. Cl. ..... 345/89

[58] Field of Search ..... 345/98, 100, 89, 345/211; 348/792, 793; 307/296.1

[56] References Cited

U.S. PATENT DOCUMENTS

| | | | |
|---|---|---|---|
| 4,801,933 | 1/1989 | Yamamoto et al. | 340/784 |
| 4,842,371 | 6/1989 | Yasuda et al. | 350/333 |
| 5,159,476 | 10/1992 | Hayashi | 359/54 |
| 5,196,738 | 3/1993 | Takahara et al. | 307/296.1 |
| 5,250,937 | 10/1993 | Kikuo et al. | 345/89 |
| 5,438,342 | 8/1995 | Yamaguchi | 345/58 |
| 5,625,387 | 4/1997 | Moon | 345/211 |
| 5,640,174 | 6/1997 | Kamei et al. | 345/89 |
| 5,774,106 | 6/1998 | Nitta et al. | 345/98 |
| 5,877,737 | 2/1999 | Kim et al. | 345/89 |

*Primary Examiner*—Matthew Luu
*Assistant Examiner*—Jeff Piziali
*Attorney, Agent, or Firm*—Skjerven, Morrill, MacPherson Franklin & Friel LLP; David T. Millers

[57] ABSTRACT

A liquid crystal display (LCD) is disclosed in which adjacent pixels having the same gray level are supplied with different magnitudes of data voltages, thereby increasing the viewing angle of the LCD. A voltage producing circuit produces two groups of gray voltages in which the magnitude of the gray voltages in the two groups are different for the same gray level. The two sets of gray voltages are delivered to the pixels by data drivers connected to left and right data lines. The pixels are arranged in matrix form and data lines are arranged along the columns. For each column, two data lines are assigned, one on the left and the other on the right. The left data lines are connected to one data driver and the right data lines are connected to another data driver. The pixels are connected so that if a pixel is connected to the left data line, then the row and column adjacent pixels are connected to the right data line. Because the adjacent pixels are supplied with different data voltages corresponding to the same gray level, the viewing angle and characteristics of the liquid crystal display are improved.

23 Claims, 5 Drawing Sheets

LIQUID CRYSTAL DISPLAY HAVING A WIDE VIEWING ANGLE AND METHOD FOR DRIVING THE SAME

BACKGROUND OF THE INVENTION

1. Field of the Invention

The present invention relates to a liquid crystal display (hereinafter referred to as an LCD) and method of driving the same, in particular, to a LCD having a plurality of pixels in which the adjacent or "contiguous" pixels are supplied with different gray voltages for the same gray scale, thereby resulting in a wider viewing angle for the LCD.

2. Description of the Related Art

An LCD includes an LCD cell having two LCD panels with electrodes and signal lines, such as gate lines and data lines, and liquid crystal material between. The LCD has a backlight unit for providing light to the LCD cell, and it has driving circuit boards and other peripheral circuitry.

A thin film transistor (hereinafter referred to as an TFT) LCD, uses TFTs as switching elements, and it has a plurality of pixels each having a TFT with a gate, a source and a drain, a storage capacitor and a liquid crystal capacitor, as well as gate lines and data lines. Each pixel displays an image according to a data voltage applied to the TFT.

The driving circuit boards contain a gate driver, data drivers, voltage producing circuits and control circuits. The gate driver is connected to the gate lines, and it applies the gate voltages through the gate lines to the gates of the TFTs, thereby activating the TFTs according to the signals from the control circuit. The data driver is connected to the data lines and applies the data voltages through the data lines to the sources of the TFTs to make the pixel display an image according to the signals from the control circuit. The gate driver and the data drivers are supplied with voltages from a voltage producing circuit. The drivers and the voltage producing circuit are controlled by the control circuit.

The LCD, particularly in a twisted nematic (hereinafter referred to as TN) mode, has a narrow viewing angle, and the optical transmission rate through the LCD is a function of the viewing angle. This dependence is due to the characteristics of the liquid crystal molecule and it is greater in the upward and downward direction than in the left to right direction, causing the asymmetrical viewing characteristics. In order to achieve a wider viewing angle, several approaches have been suggested.

Kaneko et al. discloses several methods for obtaining wide viewing angle in "Wide-Viewing-Angle Improvements for AMLCDs", SID 93 DIGEST, pp. 265–268. Suggested improvements include film compensated TN cells, pixel divided TN cells, multi-domain TN cells, and TN cells using subpixels.

Among these prior art methods, the TN cells using three subpixels will be described with reference to FIGS. 1A to 1C. FIG. 1A is an equivalent circuit diagram for a pixel with three subpixels; FIG. 1B shows the plan structure of the pixel, and FIG. 1C shows the cross-sectional structure of the pixel.

In FIG. 1C, a gate electrode 2 is formed on a lower transparent substrate 1 and a first insulating layer 4 is deposited thereon. A first transparent electrode 5 is formed on the first insulating layer 4 and connected to a TFT. A second insulating layer 14 and a second transparent electrode 15 are formed on part of the first transparent electrode 5, and a third insulating layer 24 and a third transparent electrode 25 are formed on part of the second transparent electrode 15. A common electrode 10 is formed on an upper transparent substrate 9.

In FIGS. 1A and 1C, it can be seen that a conventional liquid crystal capacitor is composed of a pixel electrode and a common electrode and is divided into three liquid crystal sub-capacitors CLC1, CLC2 and CLC3. The sub-capacitors CLC1, CLC2 and CLC3 have the first, the second and the third transparent electrodes 5, 15 and 25 respectively as one electrode and the common electrode 10 as the other electrode. In FIG. 1C, it can be seen that CLC1, CLC2, and CLC3 have different values of capacitance, because the capacitance of a capacitor is inversely proportional to the distance between the electrodes of the capacitor and is proportional to the area of the electrodes.

In FIG. 1A, control capacitors CS2 and CS3 connected in series to the sub-capacitors CLC2 and CLC3, respectively, act as voltage dividers and provide control voltages to the subpixels. The transparent electrodes 5, 15 and 25 are supplied with the same voltage, but the voltages VLCi applied between the two electrodes of the sub-capacitors CLCi (i=1, 2 and 3) are different from that applied to the other sub-capacitors. That is, the strength of the electric field applied to the liquid crystal in a subpixel is different from that applied to the other subpixels. Therefore, the pixel has domains with three different optical transmission rates, and the resultant transmission rate of a pixel is the average value of the three transmission rates of the three subpixels. Therefore, the viewing characteristics of the LCD are improved.

However, there is a significant disadvantage in the fabrication process for this type of LCD, because it requires additional steps for forming the second and the third transparent electrodes, and the second and the third insulating layers.

SUMMARY OF THE INVENTION

An object of the present invention is to improve the viewing characteristics of an LCD without increasing the number of the steps for fabricating the LCD.

An LCD according to this invention includes a means for supplying data voltages which generates the different data voltages corresponding to the same gray level. The term "contiguous pixels" means "adjacent pixels," and the terms are used interchangeably herein. Preferably, adjacent or contiguous pixels are supplied with different data voltages corresponding to the same gray level. Therefore, a pixel having the same gray level as a group of adjacent pixels will receive a different data voltage than the data voltage received by the adjacent pixels. This improves the viewing characteristics of the LCD.

One embodiment of the present invention has at least two different supplying means supplying the different data voltages corresponding to the same gray level. Preferably, each supplying means comprises means for producing a plurality of gray voltages corresponding to the gray levels, means for selecting one among the gray voltages corresponding to the data signal, and means for outputting the selected gray voltage as the data voltage to the pixels. The producing means may include a plurality of resistors connected in series.

An apparatus for driving a liquid crystal display according to the present invention includes a means for producing a plurality of gray voltages, and a means for providing a voltage gain to each gray voltage from the producing means, wherein the different providing means provide different voltage gains to the same gray voltage. The apparatus also includes means, each connected to one of the providing means, for selecting one voltage among the gray voltages from the providing means corresponding to a data signal and supplies the selected gray voltage to the pixel, wherein the different selecting means are connected to the different providing means.

Preferably, each pixel is supplied with a data voltage from the selecting means which is different from the data voltages supplied to the adjacent or contiguous pixels. One of the providing means may provide no voltage gain.

Another LCD according to the present invention includes means for producing a first and a second group of gray voltages, wherein the gray voltage corresponding to one gray level in the first group is different from the gray voltage corresponding the same gray level in the second group. The LCD also includes first and second means for selecting one voltage among the gray voltages of the first and the second groups respectively according to a data signal.

The LCD further includes a plurality of first and second data lines connected to the first and the second selecting means respectively, and to the pixels, which are arranged in a matrix form. The first and the second data lines may be aligned with the columns of pixels, so that when a pixel is connected to the first data line, the adjacent or contiguous pixels are connected to the second data lines. And the LCD further includes a means for producing a gate voltage to be applied to the pixels through the gate lines, and a plurality of gate lines connected to the pixels along the rows of pixels, wherein each pixel comprises means for switching the connection of the pixel and the data line according to the gate voltage.

A method for driving an LCD according to the present invention has the steps of producing groups of gray voltages, wherein the magnitude of the gray voltage corresponding to one gray level is different in the different groups; selecting one group of the gray voltages; and applying the gray voltage in the selected group corresponding to a data signal to a pixel. The producing step may includes the substeps of producing a group of gray voltages, and providing voltage gains to the gray voltages, wherein different voltage gains are provided to the gray voltages in different groups. Preferably, the adjacent or contiguous pixels are supplied with the gray voltages from the different group.

An LCD according to the present invention has a plurality of pixels, the contiguous pixels being applied with different data voltages corresponding to the same gray level. Therefore, the viewing characteristics are improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent from this detailed description to those skilled in the art.

BRIEF DESCRIPTION OF THE DRAWINGS

The present invention will become more fully understood from the detailed description provided below and the accompanying drawings, which are given by way of illustration only, and thus do not limit the present invention wherein.

DETAILED DESCRIPTION OF THE PREFERRED EMBODIMENTS

Figure 1A:
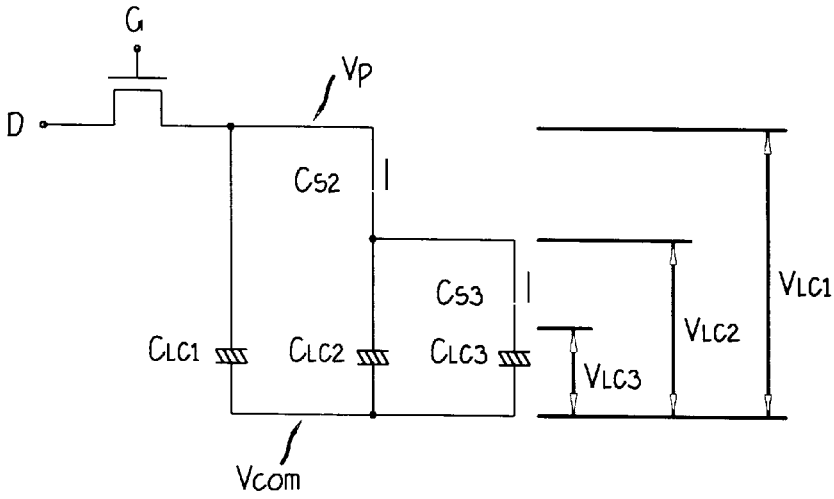
FIG.1A Prior Art
FIGS. 1A to 1C show a pixel having three sub-pixels in a conventional LCD.
Figure 1B:
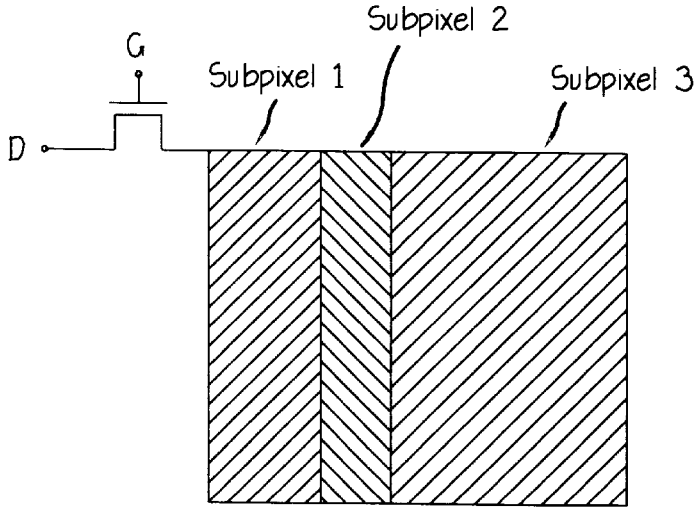
FIG.1B Prior Art
Figure 1C:
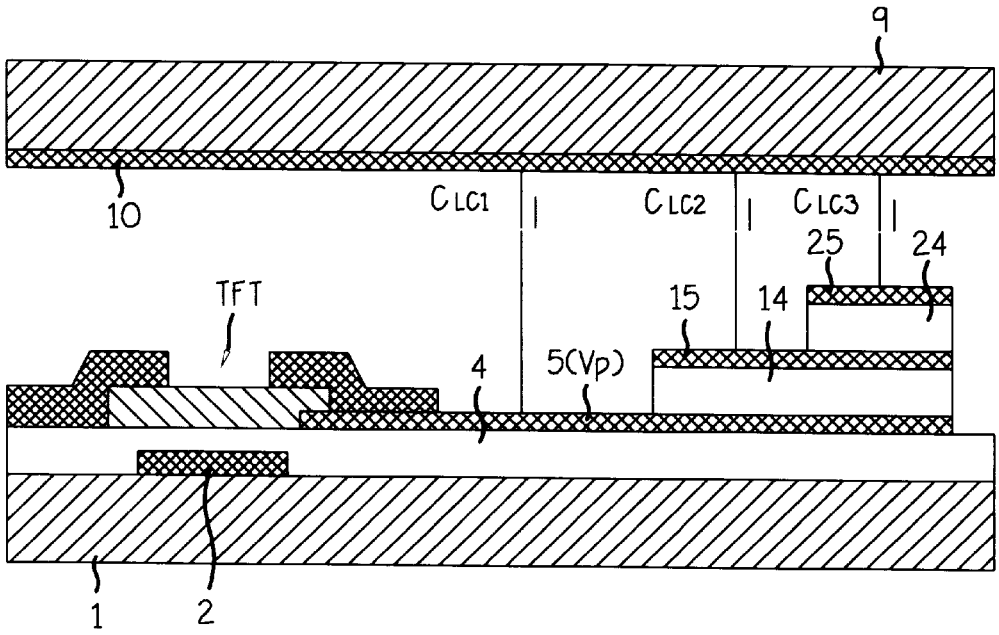
FIG.1C Prior Art
Figure 2:
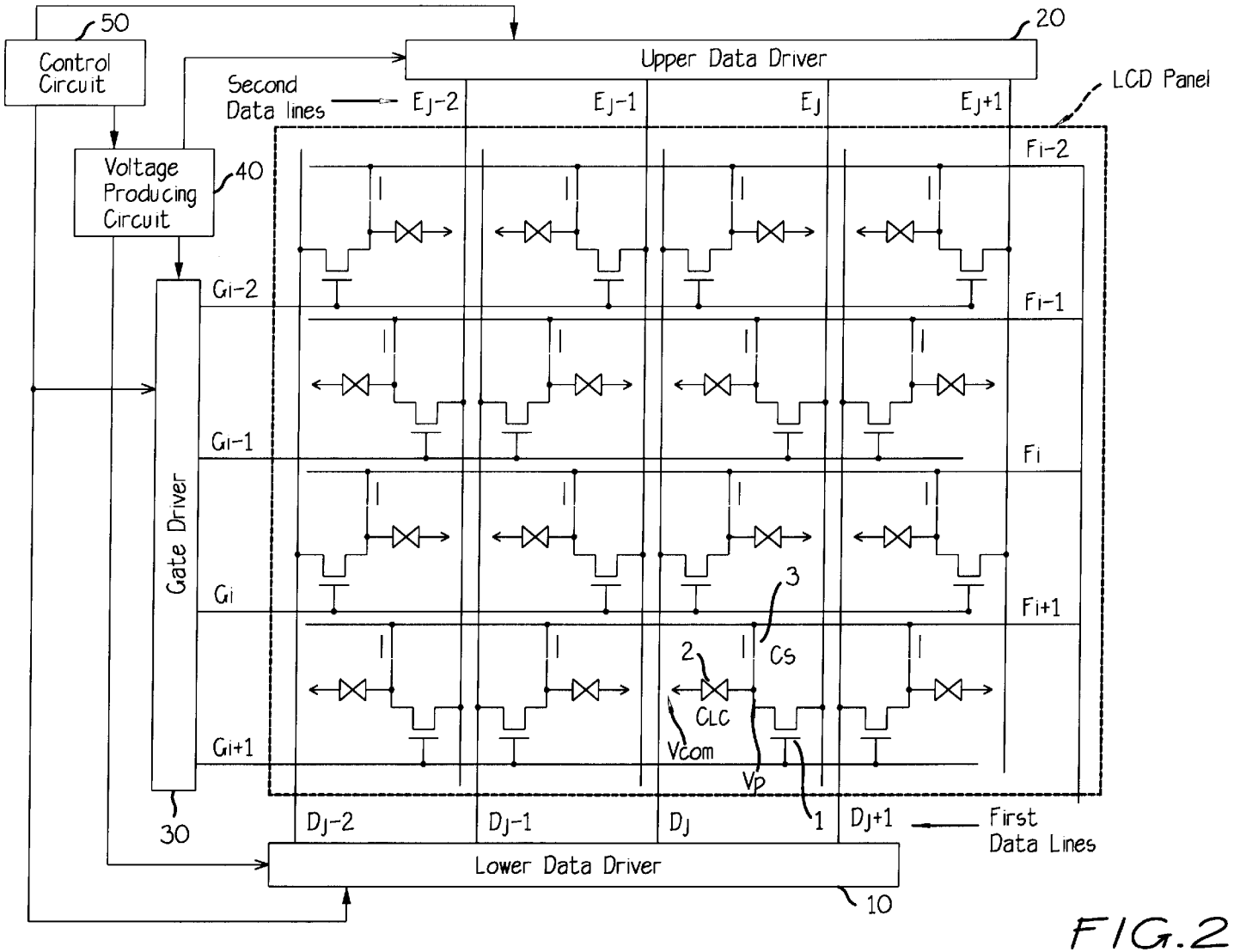
FIG. 2 shows an LCD according to an embodiment of the present invention.

FIG. 2 shows a plurality of pixels arranged in a matrix form in an LCD, each pixel having a storage capacitor 3, a liquid crystal capacitor 2, and a three terminal switching element 1 such as TFT. For convenience, let a pixel (i,j) be the pixel in i-th row and j-th column.

A plurality of gate lines G1, G2, . . . , Gi, . . . (where i is a natural number) are arranged along the rows of pixels. First data lines D1, D2, . . . , Dj, . . . and second data lines E1, E2, . . . , Ej, . . . (where j is a natural number) crossing the gate lines G1, G2, . . . , Gi, . . . are arranged along the columns of pixels. The data lines D1, D2, . . . , Dj, . . . and E1, E2, . . . , Ej, . . . are duplicated for a column of the pixels, i.e., the first data line Dj is left of the j-th column and the second data line Ej is right of the j-th column. The connection of the data line to the pixel has some rules. That is, if the pixel (i,j) is connected to the first data line Dj, the adjacent or contiguous pixels (i±1,j) and (i,j±1) are connected to the second data lines Ej and Ej±1 respectively.

Common electrode lines F1, F2, . . . , Fi, . . . are arranged along the pixel rows and provide common voltage Vcom to the pixels. The liquid crystal capacitor 2 and storage capacitor 3 are connected in parallel. One electrode of the storage capacitor 3 and one electrode of the liquid crystal capacitor 2 in a pixel are connected to one of the common electrode lines F1, F2, . . . , Fi, . . . which supplies Vcom. The other electrodes of storage capacitor 3 and liquid crystal capacitor 2 are connected together and to the drain of TFT 1. The gate of TFT 1 is connected to one of the gate lines G1, G2, . . . , Gi, . . . , and the source is connected to one of the data lines D1, D2, . . . , Dj, . . . or E1, E2, . . . , Ej . . . .

Lower and upper data drivers 10 and 20, gate driver 30, voltage producing circuit 40, and control circuit 50 are located outside of the LCD cell. Lower data driver 10 and upper data driver 20 are connected to the first data lines D1, D2, . . . , Dj, . . . and to the second data lines E1, E2, . . . , Ej, . . . respectively. Gate driver 30 is connected to the gate lines G1, G2, . . . , Gi, . . . .

Voltage producing circuit 40 is connected to and supplies data voltages and gate voltages to the data drivers 10 and 20 and gate driver 30. Voltage producing circuit 40 is also connected to and controlled by the control circuit 50. The voltage producing circuit 40 includes a data voltage producing circuit (not shown in FIG. 2) for producing data voltages and a gate voltage producing circuit (not shown) for producing gate voltages.

Figure 3:
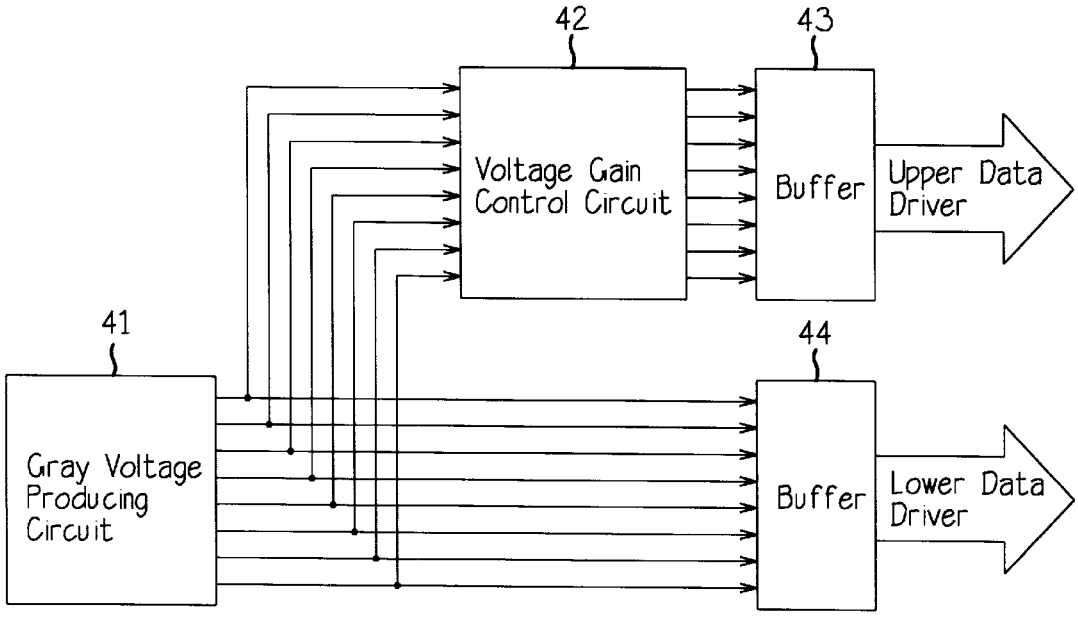
FIG. 3 is a block diagram of a data voltage producing circuit according to the first embodiment of the present invention.
Figure 4:
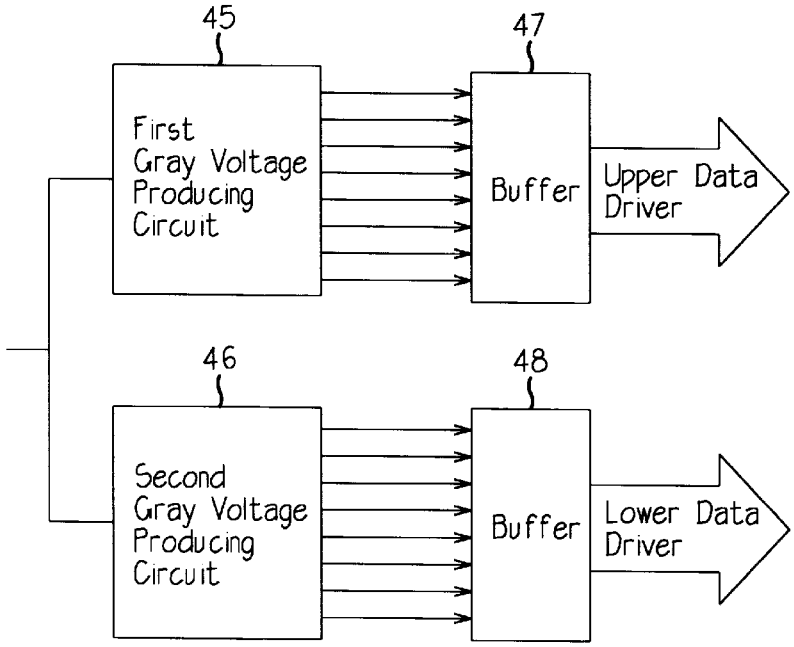
FIG. 4 is a block diagram of a data voltage producing circuit according to the second embodiment of the present invention.

In the present invention, for the same gray scale, the data voltage producing circuit delivers different magnitudes of data voltages to the upper data driver 20 than it delivers to the lower data driver 10. FIG. 3 and FIG. 4 show different configurations of the data voltage producing circuit for producing different data voltages for the same gray scale.

As shown in FIG. 3, a data voltage producing circuit according to a first embodiment of the present invention includes a gray voltage producing circuit 41 and a voltage gain control circuit 42. Gray voltages from the gray voltage producing circuit 41 are delivered through buffers 43 and 44 to the data drivers 10 and 20 via two paths. The gray voltages to be delivered to the upper data driver 20 pass through the voltage gain control circuit 42 to obtain voltage gain. But the gray voltages to be delivered to the other data driver, which in this case is the lower data driver 10, do not pass through the voltage gain control circuit 42. Therefore, the magnitudes of the data voltages delivered to the upper data driver 20 are different from that delivered to the lower data driver 10 for the same gray scale. The gray voltages pass through buffers 43 or 44, which are controlled by control circuit 50.

In FIG. 4, a data voltage producing circuit according to a second embodiment of the present invention has two gray voltage producing circuits 45 and 46. A first gray voltage producing circuit 45 and a second voltage producing circuit 46 produce gray voltages which have different magnitudes for the same gray level. The upper data driver receives voltages produced by the first gray voltage producing circuit 45, and the lower data driver 10 receives voltages produced by the gray voltage producing circuit 46. The gray voltages pass through buffers 47 or 48, which are controlled by control circuit 50.

Figure 5:
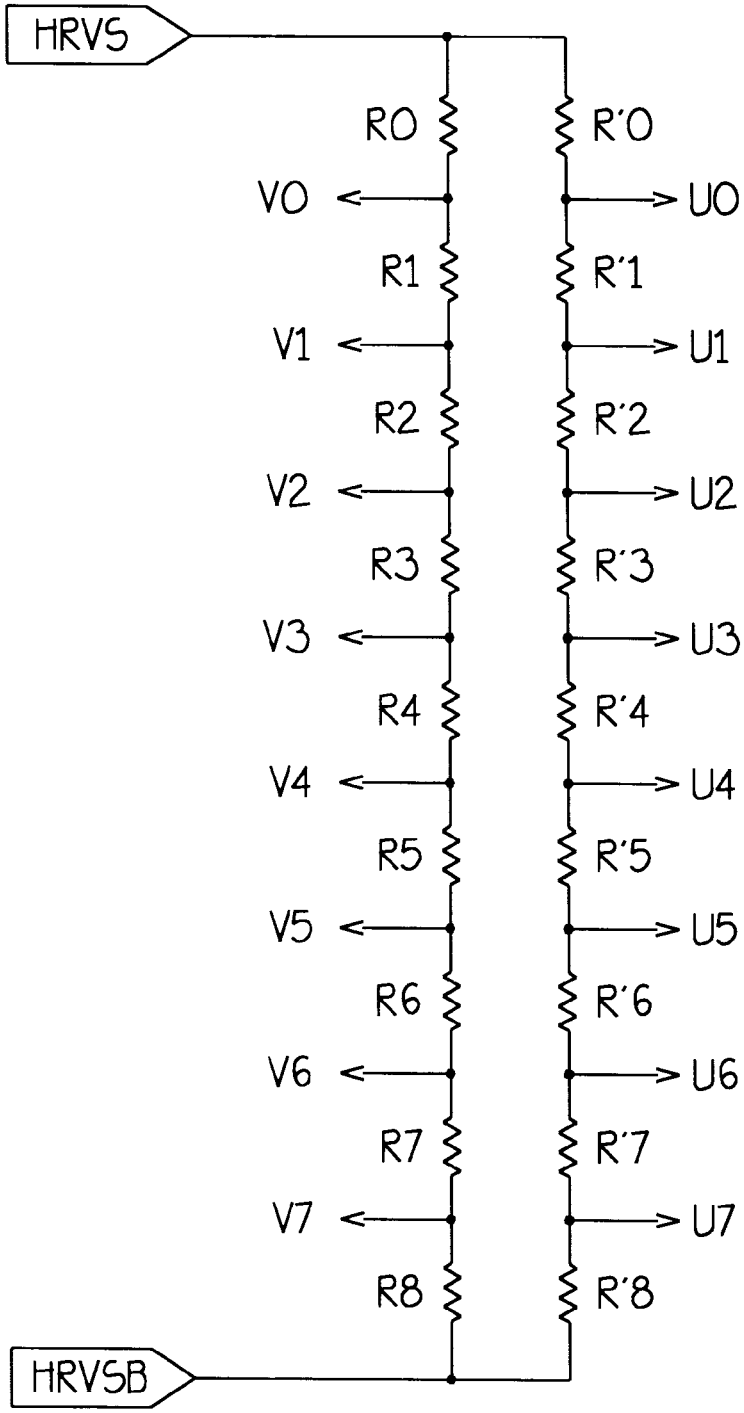
FIG. 5 shows a circuit diagram of a gray voltage producing circuit according to the second embodiment of the present invention.

FIG. 5 shows an embodiment of the circuitry for the two gray voltage producing circuits 45 and 46 shown in FIG. 4. Each gray voltage producing circuit 45 and 46 has a group of resistors and the groups are connected in parallel, as shown in FIG. 5. In the case of eight gray levels, each group has nine resistors R0 to R8 or R'0 to R'8. In FIG. 5, V0 to V7 are the gray voltages to be delivered to one data driver and U0 to U7 are the gray voltages to be delivered to the other data driver. The resistors are selected so that at least one of Rx is not equal to R'x (for x=0 to 8), so that the magnitude of the voltage Vi (i=0, 1, . . . , 7) is not equal to the corresponding voltage Ui. Therefore, when a pixel receives the voltage Vi, the adjacent or contiguous pixels having the same gray level will receive the voltage Ui.

The operation of the liquid crystal display according to the embodiments of the present invention will be described with reference to FIG. 2. The TFTs are activated in order of row by the gate voltages from the voltage producing circuit 40 via the gate driver 30 and the gate lines G1, G2, . . . , Gi, . . . and supplied with the data voltages from the voltage producing circuit 40 via the data drivers 10 and 20 and the data lines D1, D2, . . . , Dj, . . . and E1, E2, . . . , Ej, . . . . The data voltages supplied through the first data lines D1, D2, . . . , Dj, . . . are different from those through the second data lines E1, E2, . . . , Ej, . . . for the same gray level.

The control circuit 50 generates signals such as the data signals, and the voltage producing circuit 40 generates data voltages corresponding to the data signals. The data drivers 10 and 20 store the data voltages from the voltage producing circuit 40 and deliver them to the data lines.

When the gate voltage is supplied via Gi to the pixels in i-th row, the data voltages from the data drivers 10 and 20 are supplied to the pixels in i-th row through the data lines D1, D2, . . . , Dj, . . . and E1, E2, . . . , Ej, . . . . That is, the lower data driver 10 supplies the data voltages to the pixels through the first data lines D1, D2, . . . , Dj, . . . and the upper data driver 20 supplies the data voltages to the pixels through the second data lines E1, E2, . . . , Ej, . . . . The first data line Dj transmits the data voltage to the pixel (i,j) and Dj+1 transmits the data voltage to the pixel (i,j+1). The second data line Ej transmits the data voltage to the pixel (i,j) and Ej+1 transmits the data voltage to the pixel (i,j+1). Since the first data line Dj and the second data line Ej+1 are connected to the pixels (i,j) and (i,j+1) in i-th row respectively, they transmit the data voltages to the pixels (i,j) and (i,j+1). However, the first data line Dj+1 and the second data line Ej are not connected to the pixels in i-th row, so they do not transmit the data voltages to those pixels.

Therefore, the pixels in i-th row connected to the first data lines D1, D2, . . . , Dj, . . . , i.e. the pixels in the odd columns, are supplied with the data voltages from the lower data driver 10, and the pixels in i-th row connected to the second data lines E1, E2, . . . , Ej, . . . , i.e. the pixels in the even columns, are supplied with the data voltages from the upper data driver 20.

When the gate voltage is applied to the pixels in (i+1)-th row, the pixels connected to the first data lines D1, D2, . . . , Dj, . . . , i.e. the pixels in the even columns are supplied with the data voltages from the lower data driver 10, and the pixels connected to the second data lines E1, E2, . . . , Ej, . . . , i.e. the pixels in the odd columns, are supplied with the data voltages from the upper data driver 20.

Therefore, the adjacent or contiguous pixels are connected to the different data lines and they receive data voltages which have different magnitudes than the voltages received by adjacent pixels for the same gray level. As a result, because the effective voltages applied to the liquid crystals are different between the contiguous pixels and the tilt angles of the liquid crystal molecules are different between the contiguous pixels, the optical transmission rate is different for adjacent pixels having the same gray level. Because there are hundreds of thousands of pixels in an LCD, it appears that there is a liquid crystal continuum having an optical transmission rate which is the average of the two different transmission rates. Therefore, the viewing angle and the range of inversion are increased.

The invention thus being described, it will be obvious that the same may be varied in many ways. Such variations are not to be regarded as a departure from the spirit and scope of the invention, and all such modifications that would be obvious to one skilled in the art are intended to be included within the scope of the following claims.

What is claimed is:

1. A liquid crystal display comprising:

means for supplying data voltages of the same polarity corresponding to a plurality, of gray levels, wherein different data voltages correspond to one gray level; and a plurality of pixels for displaying images corresponding to the data voltages from the supplying means, wherein each of the plurality of pixels receives a selected data voltage corresponding to a selected gray level, and wherein the selected data voltage is different from the data voltages received by row or column adjacent pixels having the selected gray level.

2. A liquid crystal display comprising:

means for supplying data voltages of the same polarity, wherein the number of the supplying means is at least two and the different supplying means supply different data voltages corresponding to one gray level; and a plurality of pixels for displaying images corresponding to the data voltages from the supplying means, wherein each of the plurality of pixels receives a selected data voltage corresponding to a selected gray level, and wherein the selected data voltage is different from the data voltages received by row or column adjacent pixels having the selected gray level.

3. The liquid crystal display of claim 2, wherein each pixel is connected to one of the supplying means different from the supplying means connected to the row or column adjacent pixels.

4. The liquid crystal display of claim 2, wherein each supplying means comprises:

means for producing a plurality of gray voltages corresponding to plurality of gray levels;

means for selecting one among the gray voltages corresponding to the data signal; and means for outputting the selected gray voltage as the data voltage to the pixels.

5. The liquid crystal display of claim 4, wherein the producing means comprises a plurality of resistors connected in series.

6. An apparatus for driving a liquid crystal display having a plurality of pixels comprising:

means for producing a plurality of first gray voltages each corresponding to a gray level;

means for providing a voltage gain to the plurality of first gray voltages, thereby producing a plurality of second gray voltages having the same polarity and a different magnitude than the first gray voltages corresponding to the same gray level; and means for selecting one of the first and second gray voltages and supplying the selected gray voltage to the pixels so that adjacent pixels in a row or column having the same gray level receive a different gray voltage at the same polarity.

7. The apparatus of claim 6, wherein each pixel is supplied with the gray voltages from one of the providing means different from the providing means supplying the data voltages to the adjacent pixels.

8. The apparatus of claim 6, wherein one of the providing means provides no voltage gain.

9. A liquid crystal display comprising:

means for producing a first group and a second group of gray voltages of the same polarity, wherein the gray voltage corresponding to gray level in the first group is different from the gray voltage corresponding to the same gray level in the second group;

first means for selecting one among the gray voltages of the first group according to a first data signal;

second means for selecting one among the gray voltages of the second group according to a second data signal;

a plurality of pixels for displaying an image corresponding to the gray voltages selected by the first and the second selecting means; and a plurality of first and second data lines connected to the first and the second selecting means respectively and the pixels, wherein the pixels are arranged in a matrix of rows and columns, the first and the second data lines are aligned with the columns of pixels, and wherein when a pixel is connected to the first data line, the row and column adjacent pixels are connected to the second data lines.

10. The liquid crystal display of claim 9, further comprising:

a plurality of gate lines connected to the pixels along the rows of pixels;

means for producing a gate voltage to be applied to the pixels through the gate lines, wherein each pixel comprises means for switching the connection of the pixel and the first or second data line according to the gate voltage; and means for controlling the first and the second selecting means and the producing means.

11. A method for driving a liquid crystal display comprising the steps of:

producing at least a first group and a second group of a plurality of gray voltages of the same polarity corresponding to a plurality of gray levels, wherein for each of the gray levels the corresponding gray voltage in the first group has a different magnitude than the corresponding gray voltage in the second group;

selecting, alternately from the groups, one of the gray voltages corresponding to a specified gray level; and applying the selected gray voltage to a pixel, wherein the gray voltages are selected and applied so that adjacent pixels in a row or a column receive gray voltages from different groups.

12. The method of claim 11, wherein the producing step comprises:

producing the second group of gray voltages by applying a voltage gain of greater than or less than one to the first group of gray voltages.

13. A liquid crystal display comprising:

a plurality of substantially parallel first and second data lines arranged in an alternating pattern;

a plurality of pixels arranged in a matrix of rows and columns, each of the pixels coupled to one of either the first data lines or the second data lines in an alternating pattern wherein each pixel coupled to one of the first data lines is adjacent only to pixels coupled to the second data lines, and wherein each pixel coupled to one of the second data lines is adjacent only to pixels coupled to the first data lines;

a first voltage producing circuit coupled to the first data lines, wherein the first voltage producing circuit generates a plurality of first voltage levels corresponding to a plurality of gray levels; and a second voltage producing circuit coupled to the second data lines, wherein the second voltage producing circuit produces a plurality of second voltage levels corresponding to the plurality of gray levels, and wherein for the plurality of gray levels, the corresponding plurality of first voltage levels has the same polarity but a different magnitude from the corresponding plurality of second voltage levels.

14. A liquid crystal display as in claim 13, wherein the plurality of first and second data lines are arranged in columns, and the pixels in the row of pixels are alternately coupled to the first and second data lines, and the pixels in the column of pixels are alternately coupled to the first and second data lines.

15. A liquid crystal display as in claim 13, wherein the first voltage producing circuit is coupled via one or more first data drivers to the first data lines, and the second voltage producing circuit is coupled via one or more second data drivers to the second data lines.

16. A liquid crystal display as in claim 13, wherein the first voltage producing circuit and the second voltage producing circuit comprise a plurality of resistors coupled in series between two voltage sources.

17. A liquid crystal display as in claim 13, wherein the first voltage producing circuit comprises a first plurality of resistors coupled in series between a first voltage source and a second voltage source, and the second voltage producing circuit comprises a second plurality of resistors coupled in series between a third voltage source and a fourth voltage source.

18. A liquid crystal display as in claim 17, wherein the first voltage source is the same as the third voltage source and the second voltage source is the same as the fourth voltage source.

19. A liquid crystal display as in claim 15, wherein the first voltage producing circuit and the second voltage producing circuit comprise a plurality of resistors coupled in series between two voltage sources.

20. A liquid crystal display as in claim 19, wherein the first voltage producing circuit comprises a first plurality of resistors coupled in series between a first voltage source and a second voltage source, and the second voltage producing circuit comprises a second plurality of resistors coupled in series between a third voltage source and a fourth voltage source.

21. A liquid crystal display as in claim 20, wherein the first voltage source is the same as the third voltage source and the second voltage source is the same as the fourth voltage source.

22. A liquid crystal display as in claim 13, wherein the second voltage producing circuit comprises a voltage gain control circuit coupled to the first voltage producing circuit.

23. A liquid crystal display as in claim 15, wherein the second voltage producing circuit comprises a voltage gain control circuit coupled to the first voltage producing circuit.

* * * * *